US005575416A

United States Patent [19]

Oellerer et al.

[11] Patent Number: 5,575,416

[45] Date of Patent: Nov. 19, 1996

[54] DEVICE FOR ALIGNING AND RETAINING TWO RAILS WHOSE ENDS ARE TO BE WELDED TOGETHER

[75] Inventors: Friedrich Oellerer, Linz; Heinz Mühlleitner, St. Pölten-Flinsbach, both of Austria

[73] Assignee: Franz Plasser Bahnbaumaschinen-Industriegesellschaft M.B.H., Vienna, Austria

[21] Appl. No.: 519,820

[22] Filed: Aug. 25, 1995

[30] Foreign Application Priority Data

Sep. 1, 1994 [AT] Austria ..... 1678/94

[51] Int. Cl.[6] ..... B23K 37/04

[52] U.S. Cl. ..... 228/49.1; 228/212; 269/43

[58] Field of Search ..... 228/6.1, 44.3, 228/49.1, 212; 219/53, 101, 161; 269/43, 303; 104/15

[56] References Cited

U.S. PATENT DOCUMENTS

| | | | |
|---|---|---|---|
| 4,176,777 | 12/1979 | Bommart | 228/49.1 |
| 4,320,708 | 3/1982 | Bommart | 228/49.1 |
| 4,641,818 | 2/1987 | Bommart | 269/43 |
| 4,674,730 | 6/1987 | Roberts | 269/43 |
| 4,716,836 | 1/1988 | Hardt | 269/43 |
| 5,136,140 | 8/1992 | Theurer et al. | 219/161 |

FOREIGN PATENT DOCUMENTS

| | | | |
|---|---|---|---|
| 0017520 | 3/1983 | European Pat. Off. | 228/49.1 |
| 2830006 | 11/1988 | Germany | 228/49.1 |

*Primary Examiner*—Samuel M. Heinrich
*Attorney, Agent, or Firm*—Collard & Roe, P.C.

[57] ABSTRACT

A device for aligning and retaining two rails having abutting ends to be welded together comprises a rigid frame, abutments on the frame for the rail head tread and one of the rail head sides spaced from each in a longitudinal direction along the rails, the abutments for the rail head tread being adjustable relative to the frame for engaging the rail head tread, and retaining yokes for frictionally engaging the rails and clamping the device to the rails, the retaining yokes being associated with the frame and extending in a direction extending perpendicular to the longitudinal direction.

12 Claims, 2 Drawing Sheets

Fig. 2
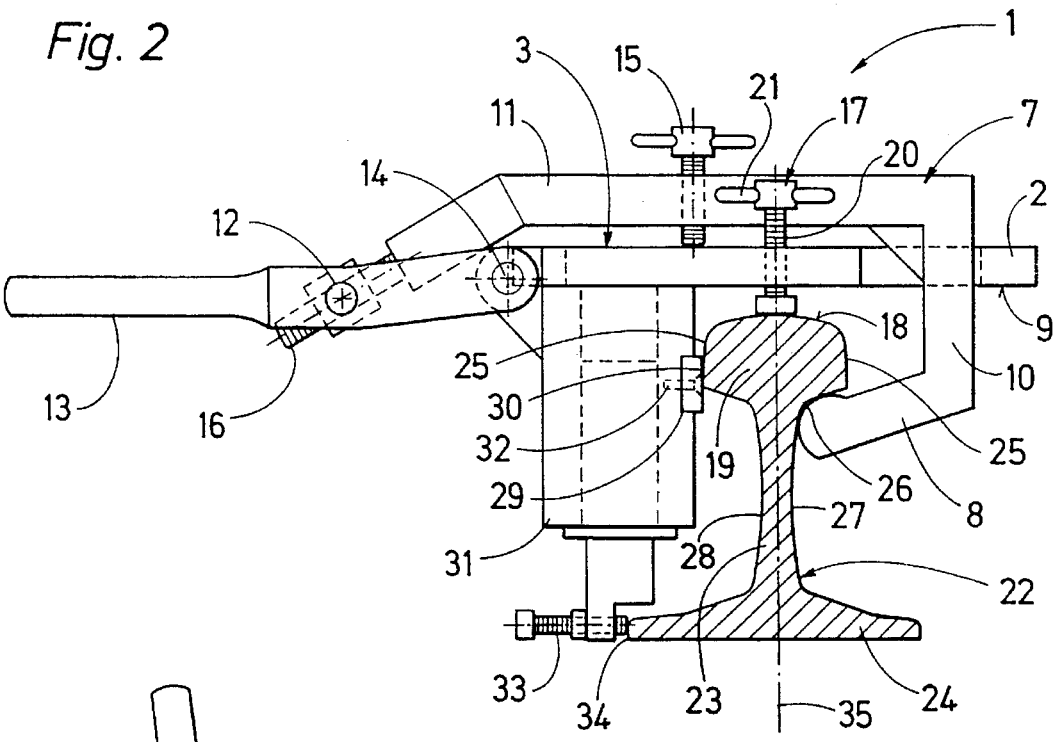
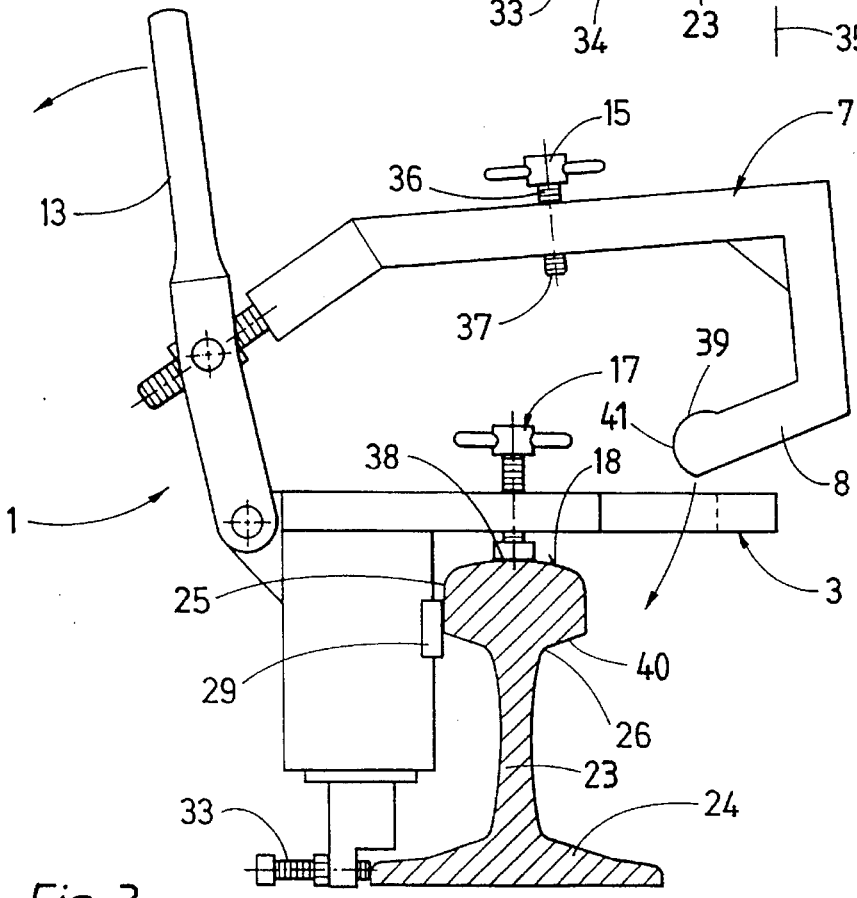
Fig. 3
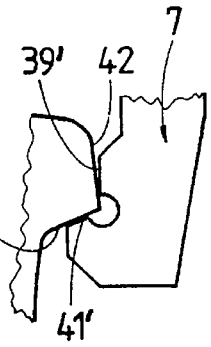
Fig. 4

DEVICE FOR ALIGNING AND RETAINING TWO RAILS WHOSE ENDS ARE TO BE WELDED TOGETHER

BACKGROUND OF THE INVENTION

1. Field of the Invention

The present invention relates to a device for aligning and retaining two rails having abutting ends to be welded together, the rails comprising a rail head having a tread, an underside and sides connecting the tread and underside, a rail foot and a web connecting the rail head and foot, which comprises a rigid frame, abutments for the rail head on the frame spaced from each in a longitudinal direction along the rails, and retaining yokes for frictionally engaging the rails and clamping the device to the rails, the retaining yokes being associated with the frame and extending in a direction extending perpendicular to the longitudinal direction.

2. Description of the Prior Art

European patent No. 17,520 discloses such a device for centering abutting ends of two rails. It comprises a frame extending in a horizontal plane and positioned sideways of the rail heads, and abutments for engaging the rail head tread and one of the rail head sides on the frame. Additional abutments for the opposite rail head sides formed as threaded spindles extending horizontally and perpendicularly to the longitudinal direction of the rails are adjustably mounted on a retaining yoke connected to the frame. With this device, it is not possible to align the rail head treads of the rail ends to be welded together in a single plane, particularly if the cross sectional profiles differ from each other.

German patent No. 2,830,006 discloses a structurally very complex device for aligning and retaining abutting rail ends. The rail ends are centered by jaws hydraulically pressed against the rail webs. Again, the rail head treads cannot be accurately aligned in a common plane.

U.S. Pat. No. 5,136,140 discloses a rail tensioning apparatus with which the abutting rail ends may be pulled together under very high tensile forces while being centered in respect of each other. This apparatus serves primarily to correct any minor bending caused by the high tensile forces.

SUMMARY OF THE INVENTION

It is the primary object of this invention to provide a device of the first-described type which enables the rail head treads of the two abutting rail ends to be accurately aligned.

The above and other objects are accomplished in such a device with abutments for the rail head tread which are adjustable relative to the frame for engaging the rail head tread.

Such a device makes it possible to make exact contact between the respective abutments and one side of the rail heads and the rail tread while the rail head is clamped in position so that, regardless of the possibly uneven degree of wear of the rail heads to be welded together, an exact alignment of the two rail head treads in a common plane is possible. This eliminates time-consuming rail grinding operations after the welding. Because the abutments for the rail head treads are adjustable, the rail head treads may be accurately adjusted with respect to each other, independently of the cross sectional profile of the two rail ends, with the possibility of providing a very small angle between the two rail ends within a common vertical plane of symmetry extending in the longitudinal direction of the rails to cause a desired pre-tension. Thus, simple and speedy centering may be accomplished with a device which is inexpensive, easy to construct and light in weight.

BRIEF DESCRIPTION OF THE DRAWING

The above and other objects, advantages and features of the invention will become more apparent from the following description of certain now preferred embodiments thereof, taken in conjunction with the accompanying drawing wherein

FIG. 2 is an end view of the device in an operating position wherein the rails are clamped in alignment with each other;

FIG. 3 is an end view of the device, with the retaining yoke released; and

FIG. 4 is a fragmentary end view of a modified device.

DETAILED DESCRIPTION OF PREFERRED EMBODIMENTS

Figure 1:
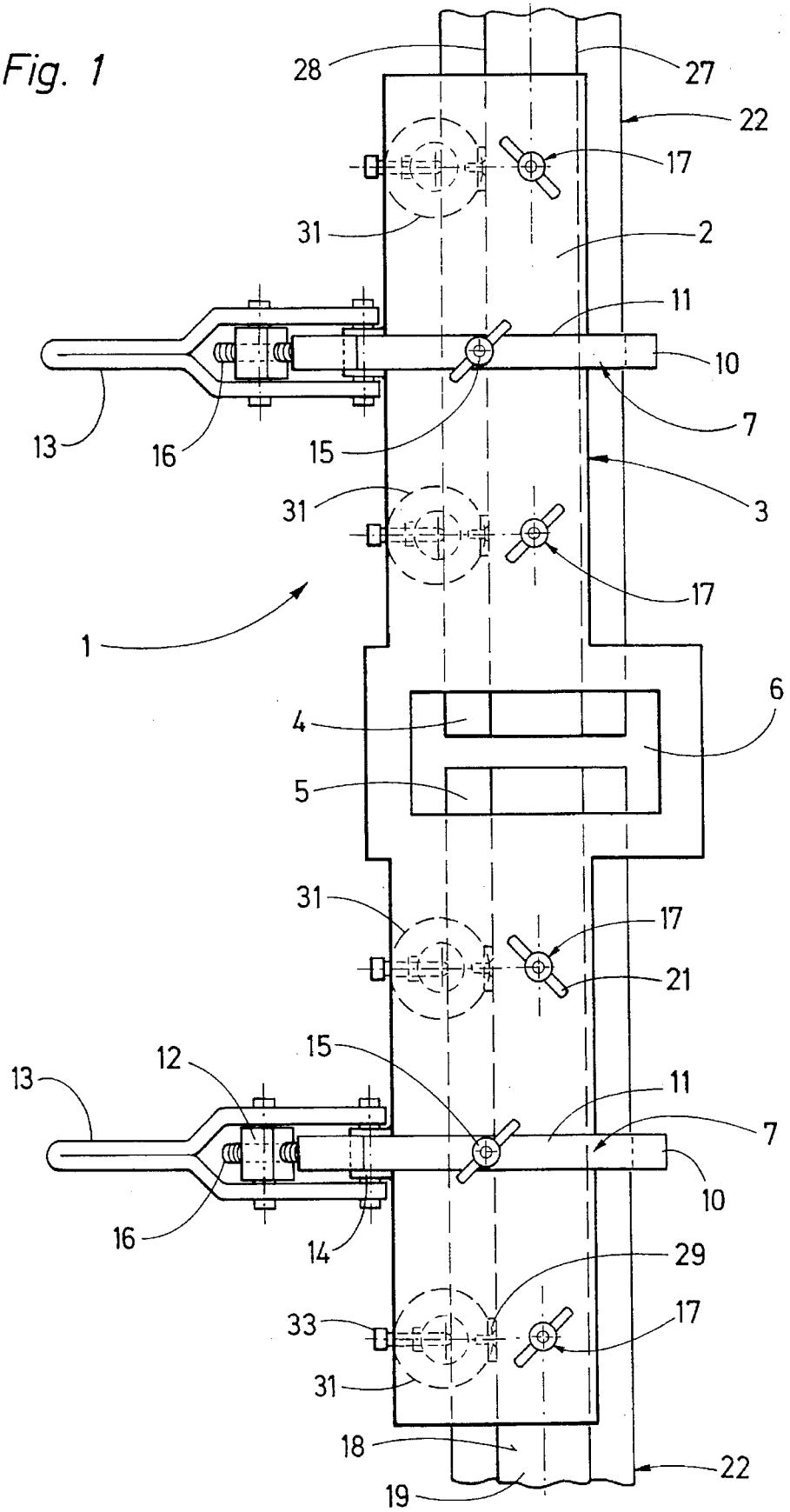
FIG. 1 is a top view of the device.

Referring now to the drawing, FIGS. 1 to 3 show device 1 for aligning and retaining two rails having abutting ends 4, 5 to be welded together. The rails comprise rail head 19 having tread 18, underside 40 and sides 25 connecting the tread and underside, rail foot 24 and web 23 connecting the rail head and foot. The device comprises rigid frame 3, abutments 17, 29 on the frame for rail head tread 18 and one of the rail head sides 25 spaced from each other in a longitudinal direction along the rails. Abutments 17 for the rail head tread are adjustable relative to frame 3 for engaging rail head tread 18. Two retaining yokes 7 frictionally engage the rails and clamp device 1 to the rails, the retaining yokes being associated with frame 3 and extending in a direction extending perpendicular to the longitudinal direction.

As shown in FIG. 4, each retaining yoke 7 may have a first abutment face 39' arranged to engage rail head side 42, and a second abutment face 41' spaced from the first abutment face and arranged to engage rail head underside 40.

In the embodiment shown in FIG. 2, retaining yoke 7 has an abutment face 39, 41 arranged to engage underside 40 of the rail head and web 23 in a transition zone 26 curving between the web and the underside.

The illustrated frame is a plate positioned perpendicularly to a vertical plane of symmetry extending in the longitudinal direction, the plate having opening 6 above the two abutting rail ends 4, 5 to be welded together, the opening enabling welding tools (not shown) to be passed through.

Each retaining yoke 7 is arranged between two of the abutments 29 for one of the rail head sides 25, as shown in FIG. 1. It comprises a pressure shank 8 for frictionally engaging the rails, an adjoining vertical arm 10 extending substantially perpendicularly to plane 9 defined by frame 3, and a tension arm 11 connected to the vertical arm. The tension arm extends above frame 3, perpendicularly to the longitudinal direction and substantially parallel to frame plane 9. The retaining yoke further comprises a rocker arm 13, joint 12 linking an end of tension arm 11 opposite vertical arm 10 to rocker arm 13, and another joint 14 linking rocker arm 13 to frame 3. The other joint 14 is arranged in the region of frame plane 9 at a longitudinal edge of the frame close to abutments 29 for the one rail head side 25.

As shown in FIGS. 2 and 3, the tension arm end encloses an acute angle with frame plane 9, and threaded bolt 16 longitudinally adjustably connects joint 12 to the tension arm end. The joints respectively connect the tension arm end to rocker arm 13 and the rocker arm to frame 3 for pivoting about axes extending in the longitudinal direction. Furthermore, a spacing member 15 between tension arm 11 and frame 3 enables the distance therebetween to be selectively changed. The spacing member is a threaded bolt mounted on the tension arm, the threaded bolt having a longitudinal extension extending substantially perpendicularly to frame plane 9 and having an abutment face 37 for engaging the frame.

As shown in FIG. 1, two abutments 17 for the rail head tread and two abutments 29 for the one rail head side 25 are provided for each rail end 4, 5, and a retaining yoke 7 is arranged between the two abutments. Abutments 17 are threaded bolts 20 carrying cross pins 21 at an upper end above frame 3, in which the bolts are mounted, to form toggle bolts.

As best shown in FIG. 2 illustrating device 1 in its operating position, the free end of pressure shank 8 carries abutment faces 39, 41engaging transition zone 26 curving between underside 40 and longitudinally extending side 27 of web 23 of the rail. The one side 25 of rail head 19 at opposite longitudinally extending side 28 of rail web 23 is engaged at its lower end by abutments 29. Bearing blocks 31 are affixed to an underside of frame 3, each abutment 29 for the one rail head side 25 being affixed to a respective one of the bearing blocks, and abutment face 30 is adjustable relative to the bearing block in a direction extending perpendicularly to the longitudinal direction and parallel to plane 9 defined by frame 3 by screw 32.

A further abutment 33 at a lower free end of each bearing block 31 is arranged to engage longitudinal edge 34 of rail foot 24 and is adjustable in a direction extending perpendicularly to the longitudinal direction and parallel to a plane defined by the frame.

When device 1 is operated to align rail ends 4, 5 and to retain them in the aligned position, it is placed upon the rail ends with released retaining yoke 7 (as shown in FIG. 3) so that the abutting rail ends to be welded together are accessible through opening 6 of frame 3 (see FIG. 1). In this position, abutment faces 38 of abutments 17, which extend parallel to frame plane 9, contact rail head tread 18 and abutment faces 30 of abutments 29 contact the one rail head side 25. The engagement of further abutments 33 with longitudinal edge 34 of rail foot 24 prevents tilting of device 1. Retaining yokes 7 are then lowered from their position shown in FIG. 3 to that illustrated in FIG. 2 by pivoting rocket arm 13 so that pressure arms 8 subtend rail head 19 and abutment faces 39, 41 contact transition zones 26 at rail side 27 opposite abutments 29. This causes abutment faces 39 to be pressed against undersides 40 of rail heads 19 and abutment faces 41 to be pressed against webs 23 of rail ends 4, 5. When rocker arm 13 is pressed down beyond its dead center position into the position shown in FIG. 2, pressure arm 8 will exert a strong pressure against underside 40 of rail head 19 to clamp the rail head tightly between abutment face 39 and abutment face 38. The clamping force may be varied by turning threaded bolt 16 and/or spacing member 15. The adjustment of spacing member 15 may also be used to change the pressure force of abutments 17 on rail head treads 18 of rail ends 4, 5.

When retaining yoke 7 has thus been positioned for frictional engagement of device 1 with rail ends 4, 5, an exact alignment of the rail head treads of rail ends 4, 5 in plane of symmetry 35 of the rail ends can be obtained by adjusting abutments 17, i.e. by turning the toggle bolts constituting the abutments until rail head treads 18 lie in a common plane at the plane of symmetry. By suitably adjusting abutments 17, 29, 33, each constituted by threaded bolts, such an accurate alignment may be obtained even if the cross sectional profiles of the rail ends differ from each other. For this purpose, further abutment 33 is vertically adjustably mounted on bearing block 31. The adjustment of further abutment 33 enables frame plane 9 to be repositioned with respect to plane of symmetry 35.

What is claimed is:

1. A device for aligning and retaining two rails having abutting ends to be welded together, the rails comprising a rail head having a tread, an underside and sides connecting the tread and underside, a rail foot and a web connecting the rail head and foot, which comprises (a) a rigid frame, (b) abutments on the frame for the rail head tread and one of the rail head sides spaced from each in a longitudinal direction along the rails, (1) the abutments for the rail head tread being adjustable relative to the frame for engaging the rail head tread, and (c) retaining yokes for frictionally engaging the rails and clamping the device to the rails, the retaining yokes being associated with the frame and extending in a direction extending perpendicular to the longitudinal direction.

2. The device of claim 1, wherein each retaining yoke has a first abutment face arranged to engage the underside of the rail head, and a second abutment face spaced from the first abutment face and arranged to engage a rail head side opposite the one rail head side.

3. The device of claim 1, wherein each retaining yoke has a first abutment face arranged to engage the underside of the rail head, and a second abutment face spaced from the first abutment face and arranged to engage the web at a side thereof opposite the one rail head side.

4. The device of claim 1, wherein the frame is a plate positioned perpendicularly to a vertical plane of symmetry extending in the longitudinal direction, the plate having an opening above the two abutting rail ends to be welded together.

5. The device of claim 1, further comprising bearing blocks affixed to an underside of the frame, each abutment for the one rail head side being affixed to a respective one of the bearing blocks and being adjustable in a direction extending perpendicularly to the longitudinal direction and parallel to a plane defined by the frame.

6. The device of claim 5, further comprising a further abutment at a lower free end of each bearing block, the further abutment being arranged to engage a longitudinal edge of the rail foot and being adjustable in a direction extending perpendicularly to the longitudinal direction and parallel to a plane defined by the frame.

7. The device of claim 1, wherein each retaining yoke is arranged between two of the abutments for the one rail head side.

8. The device of claim 1, wherein each retaining yoke comprises a pressure shank for frictionally engaging the rails, an adjoining vertical arm extending substantially perpendicularly to a plane defined by the frame, a tension arm connected to the vertical arm, the tension arm extending above the frame, perpendicularly to the longitudinal direction and substantially parallel to the frame plane, and a rocker arm, a joint linking an end of the tension arm opposite the vertical arm to the rocker arm, and another joint linking the rocker arm to the frame.

9. The device of claim 8, wherein the other joint is arranged in the region of the frame plane at a longitudinal edge of the frame close to the abutments for the one rail head side.

10. The device of claim 8, wherein the tension arm end encloses an acute angle with the frame plane, further comprising a threaded bolt longitudinally adjustably connecting the joint to the tension arm end.

11. The device of claim 7, further comprising a spacing member between the tension arm and the frame for selectively changing the distance between therebetween.

12. The device of claim 11, wherein the spacing member is a threaded bolt mounted on the tension arm, the threaded bolt having a longitudinal extension extending substantially perpendicularly to the frame plane and having an abutment face for engaging the frame.

* * * * *